United States Patent [19]

Dashevsky

[11] Patent Number: 4,845,899

[45] Date of Patent: Jul. 11, 1989

[54] CASSETTE TYPE TOOLING FIXTURE

[75] Inventor: Leon G. Dashevsky, Plymouth, Minn.

[73] Assignee: MAR Engineering, Inc., Hopkins, Minn.

[21] Appl. No.: 129,722

[22] Filed: Dec. 7, 1987

[51] Int. Cl.[4] ..... B24B 41/06

[52] U.S. Cl. ..... 51/217 R; 51/165.75; 269/134; 269/264; 269/277

[58] Field of Search ..... 51/217 R, 216 R, 165.74, 51/165.75, 109 R, 122, 231, 283 R, 283 E; 269/134, 264, 277

[56] References Cited

U.S. PATENT DOCUMENTS 3,397,880 8/1968 Kuban ..... 269/134

OTHER PUBLICATIONS

Drawing of prior art described in introductory part of application.

*Primary Examiner*—Frederick R. Schmidt

*Assistant Examiner*—Maurina Rachuba

*Attorney, Agent, or Firm*—Kinney & Lange

[57] ABSTRACT

A cassette type part clamping member holding precision parts of small size to very close tolerances. The parts are clamped in a manner so that they are securely held but are not damaged. The cassette mounts relatively easily made, low cost, and useful reference bar for providing a reference surface against which the parts are clamped and also against which a sensor will operate during an operation such as grinding to insure that a straight grind cut is made. The cassette that holds the part clamping members and the reference bar, and a separate outer cassette holder fixture which provides reference surfaces for supporting the reference bar holding it in position accurately and without affecting the preload on the clamping members is mounted on the tool table. The cassette can be removed from and replaced into the holding fixture without releasing the parts.

14 Claims, 6 Drawing Sheets

118
115
40A
106
108
105
24B
23
10
24
26
11
30
12
32
3
24A
24C
85
93
35
70
81
80
67
40C
36
108A
103
105
115
118
106
25C
37
84
93
25A
25B
107
25
14
20
21
TABLE DRIVE

CASSETTE TYPE TOOLING FIXTURE

BACKGROUND OF THE INVENTION

1. Field of the Invention.

The present invention relates to a tooling fixture for precision machining operations that uses a cassette and cassette holder for clamping and for positively placing small precision parts in a reference position for grinding or machining precision parts that are to be ground or machined.

2. Description of the Prior Art.

Precision machining operations on very brittle, and thin parts such as ferrite read/write cores for magnetic heads in computer applications, have been a substantial problem because the parts are extremely small, very brittle, and have to have the core ground down to form a narrow flange on one side of the core. Compounding the problem is the fact that the cores have holes in them, and the hole actually extends into the grinding path that is needed. At the present time, the parts are clamped with rubber-faced clamps, and held against a reference surface, which is ground on a large tooling fixture. The parts are only in the range of 0.060 inches square, and the portion of the part that is to be ground has to protrude out of the clamp so that the grinding wheel can engage it. That leaves a very small surface area on the part for clamping. The rubber on rubber-faced jaws tends to extrude out around the outer edges and also into the openings in the parts. Because the available clamping surface area is quite small, attempting to hold the parts tightly when the parts are being clamped results in high localized loads and excessive breakage, as well as the difficulty in removing the parts after they have been ground.

The edges of the parts opposite from the ground ends are supported on a narrow shoulder or ledge surface because close tolerances are needed, and since the parts have very sharp corners, the corner where the ledge surface joins the reference surface against which the parts are clamped has to be relieved, with a relief groove. That leaves the edge portion of the part resting on the support ledge unsupported on a side opposite the clamping side. The clamping forces of rubber, which again tends to extrude, will place sufficient load on this unsupported edge portion so many parts will crack when they are loaded against the reference surface, because they are unsupported where the relief groove at the corner junction with the support shoulder is formed.

The ferrite parts also have irregularities on the side surfaces which are clamped and such irregularities also can cause cracking when the parts are clamped.

All of these problems result in a high breakage factor, and difficulty in loading and unloading the parts. A sensor is used for controlling tool table movement along the axis of the grinding wheel and the sensor rides on an exposed portion of the reference surface. During grinding operations, the table is moved in direction parallel to the reference surface. A number of parts can thus be ground at once, and the sensor sliding along the reference surface will tend to wear grooves or irregularities in the reference surface. When the wear exceeds tolerances the entire fixture, in the prior art devices, has to be reground or replaced, and this is time consuming and quite expensive. Downtime is a problem because the fixtures are so expensive that having extra fixtures is avoided.

The present invention provides for a cassette designed to alleviate the excessive breakage problems and makes the parts easy to load and unload, as well as providing a replaceable reference bar that provides not only a reference clamping surface but also a reference surface for sensor travel.

SUMMARY OF THE INVENTION

The present invention relates to a part holding, separately, loadable cassette for machining precision parts in an operation such as grinding, where a plurality of thin, flat, small parts are clamped against a reference surface with a small portion of the part protruding above a clamping jaw so that a grinding wheel can be run in direction parallel to the reference surface for grinding a ledge or shoulder in the parts. The cassette provides a rubber-faced clamping jaw for accomodating irregularities in the parts, without causing excessive breakage, and yet supporting the parts positively against the reference surface.

The reference surface of the device of the present invention is formed on a side of a rectilinear reference bar. Each of the side surfaces of a square reference bar may comprise a reference surface or sides of a supplemental bar also may be used, but only one of the surfaces is used for part clamping at a time. The reference bar means is held on a cassette body having a clamping jaw, and is seated in the cassette body on a precisely ground flat surface that is adjacent to the jaw and perpendicular to the reference surface. The piece parts are clamped between the jaw and the reference bar against a reference surface. When thin parts are held and ground, the edges of the piece parts opposite the edge which is ground are held on the edge of a shim that is seated against a precisely located shoulder on the cassette body. The shim extends parallel to the reference surface.

The clamping jaw has a rubber insert jaw face that extends along the length of the jaw parallel to the reference surface. In one form of the invention, the rubber insert has a surface area that overlaps the edge of the shim and the shim supported edges of the piece parts, so that a greater surface area is provided to permit easier adjustments of the clamping forces without breaking the piece parts. The shim is substantially the same thickness as the piece parts, and provides a support edge precisely parallel to the reference shoulder, for supporting the edges of the piece parts in position for grinding. When clamping, the unit load or pressure on the rubber surface of the jaw can be controlled and reduced, and this helps to equalize the forces so that there are not any unwanted excessive stresses in the piece parts causing breakage.

Additionally, in the first form of the invention, the entire side portion of the piece part opposite the clamping jaw is supported fully against the reference surface, because there is not any need for a relief groove in the reference surface along the shim edge, and a very sharp corner is formed by the shim and the reference surface. Because the overall surface area of the clamping rubber jaw insert is greater, it is easier to adjust the total clamping force without causing excessive unit force changes. This is another problem that has been associated with the prior art, namely that any adjustment of the clamping force can cause an overloading which in turn again will tend to cause part breakage because of unevenness of the side surfaces of the parts.

The cassette body is formed so that the reference bar protrudes out from the opposite ends of the cassette body when the bar is mounted in place. The surface of the reference bar which perpendicular to the reference surface being used is supported on the flat ground surface of the cassette body to position the reference bar in a known location very precisely, so that the parts that are held against the reference bar and the reference edge of the shim will also be located with precision.

The exposed ends of the reference bar means in both forms of the invention are then clamped in position in a previously mounted cassette holding fixture, without changing the cassette at all, so that the parts are still maintained in their desired clamped location.

As the parts are ground, a sensor is used for sensing the position of a reference surface of the reference bar means in direction parallel to the rotational axis of the grinding tool, and the sensor runs against an exposed portion of the reference surface as the parts are moved past the grinding wheel or other tool. The reference surface has sufficient size so that the sensor can be quite easily placed against an exposed portion thereof that is out of the clamping area for the parts.

The clamping action is accomplished by moving reference bar and the jaw of the part holding cassette together for clamping. The clamping action can be accomplished b moving the jaw toward the stationary reference bar as well as shown herein. When the parts have been ground, the cassette can be removed from the cassette holding fixture and the reference bar is loosened slightly, and the piece parts are released from pressure of the jaw. When several parts are being worked on, the cassette can be tilted so the reference surface faces upwardly so the parts do not fall out when they are released. In order to remove piece parts from the rubber jaw face, which tends to extrude into the openings of the parts and form a "footprint" on the rubber, the support shim can be moved slightly in a direction parallel to the reference surface to release the piece parts without causing damage. The removal does not require individually picking the piece parts off the rubber face of the clamping jaw.

When the reference surface of the reference bar that is first used becomes worn because of the sliding of the sensor against the surface, or if it is damaged in any way, the reference bar merely has to be rotated or flipped over for positioning a second surface of the reference bar in proper location for the reference surface.

Square bars can be ground and lapped to be perfectly square and with flat side surfaces, and with each of the adjacent surfaces exactly 90° to each other. Additionally, the formation of the shoulder on the cassette body that provides the reference edge surface for the shim is done precisely and is not on the same block as the reference surface used for clamping. Thus, the shoulder surface can be used for extended periods without replacing the cassette body. Because the shim can be ground to have exactly parallel edges, the reference edge surface for supporting the work pieces can be held precisely. The work pieces are not supported directly on the cassette body.

The surface for supporting the reference bar on the cassette body likewise can be ground to very precise flatness and parallel to the support shoulder for the shim, and thus parallel to the support edge for the work pieces.

Where parts are clamped at an oblique angle to the axis of the grinding wheel as shown in a second form of the invention, the same features of precise location rising a bar that can be changed in position to use at least two reference surfaces of a bar for sensor travel so when one surface is worn another can be positioned for use.

In the cassette holding fixture, likewise, the reference locating surfaces that support and locate the ends of the reference bar can be ground easily because they are easily accessed. The surfaces on the cassette body and on the fixture for holding the cassette do not have to be reconditioned, because they have no wearing parts against them, and the only replacement part that needs to be kept in reserve is the reference bar. The square reference bar form has four side surfaces that can each operate as a reference surface, and the bar can be flipped end for end so that each of the side surfaces can be used twice for providing a reference surface area for the sensor, the bar does not have to be replaced very often and thus there is no need to replace expensive large bodies that need precision grinding on intricate surfaces.

Additionally, the cassette is made so that it can be loaded into the fixture in a manner that lessens the likelihood of damage to any of the exposed surfaces of the reference bar.

The cassette holding fixture has guide tracks on which the assembled cassette can be placed, and moved along the tracks. The path of movement is such that the support surfaces of the cassette holding fixture which engage the outer ends of the reference bar will be aligned with the reference bar, and as the cassette is moved down these tracks, the reference bar is gently lowered onto its mating surfaces on the cassette holding fixture. The cassette then can be slid into place against reference shoulder surfaces that engage the reference surface on the reference bar and positively position the reference surface of the reference bar at the desired location.

The device thus not only produces more yield for a batch of parts, because of reduced breakage and because of the ability to hold tolerances, but also reduces the overall cost of tooling and operation in a simple and efficient manner.

DETAILED DESCRIPTION OF THE PREFERRED EMBODIMENTS

Figure 1:
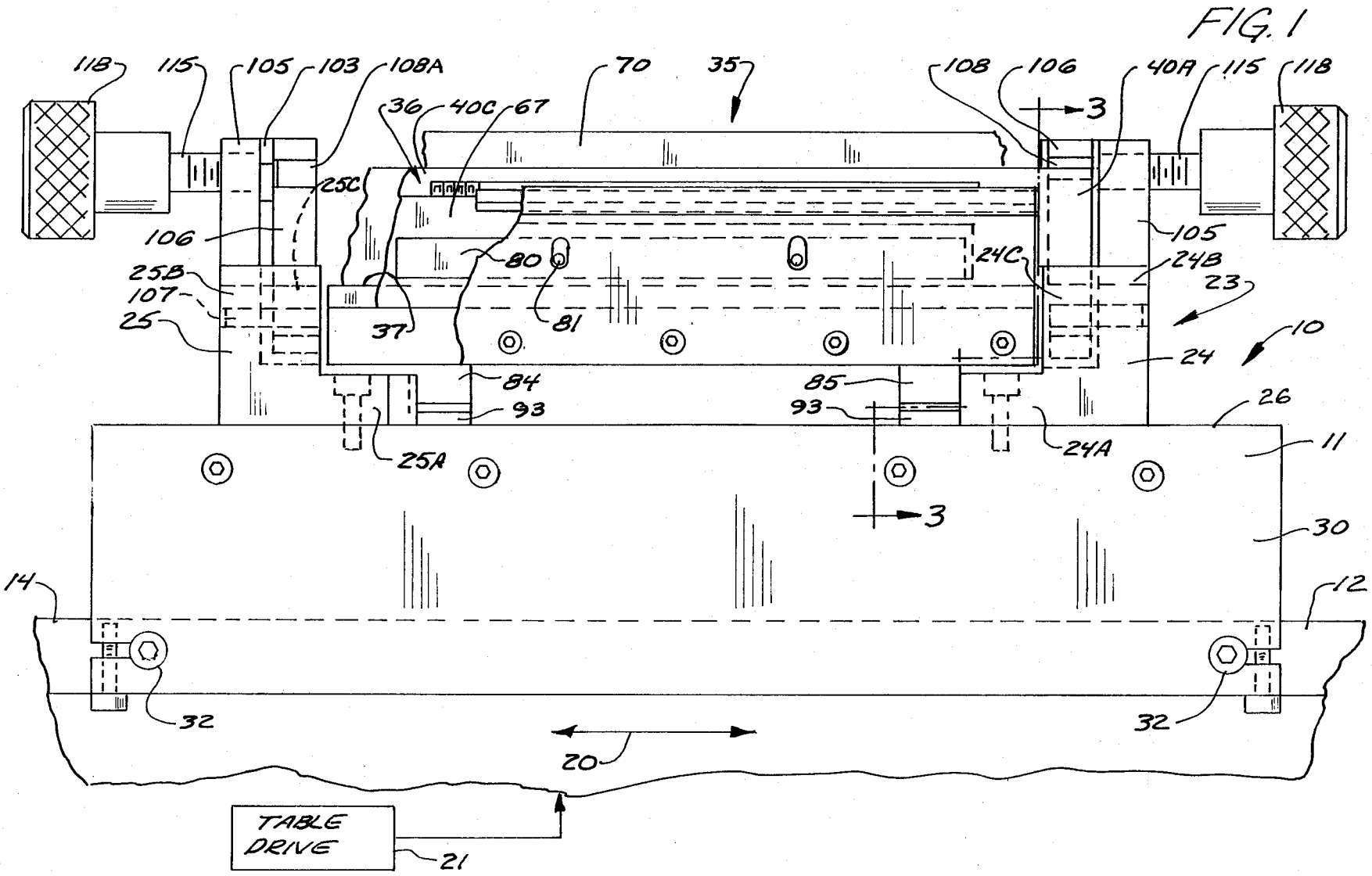
FIG. 1 is a front elevational view of a cassette holding fixture, with a cassette in place on an adaptive control system and tool table, with parts in section and parts broken away.

Referring to FIG. 1, a tooling assembly indicated generally at 10 includes a fixture base 11 which is adapted to be mounted onto portions of an adaptive control table indicated generally at 12 which is controlled in a manner shown in U.S. Pat. No. 4,602,459, and which is controlled to maintain the upper surface 14 of the adaptive control table in a desired parallel orientation with respect to the axis of rotation of a tool, such as a grinding wheel as will be shown. The adaptive control system is mounted onto a machine tool table, which can be moved along two perpendicular axes, one axis being in direction in and out parallel to the rotational axis of the machine tool, as shown in U.S. Pat. No. 4,602,459, and the machine tool table also can be moved in a direction perpendicular to the axis of rotation of the machine tool, which direction is indicated by the double arrow 20, and the machine tool table can be driven through the use of a table drive 21 that is only schematically shown because it is conventional.

Figure 3:
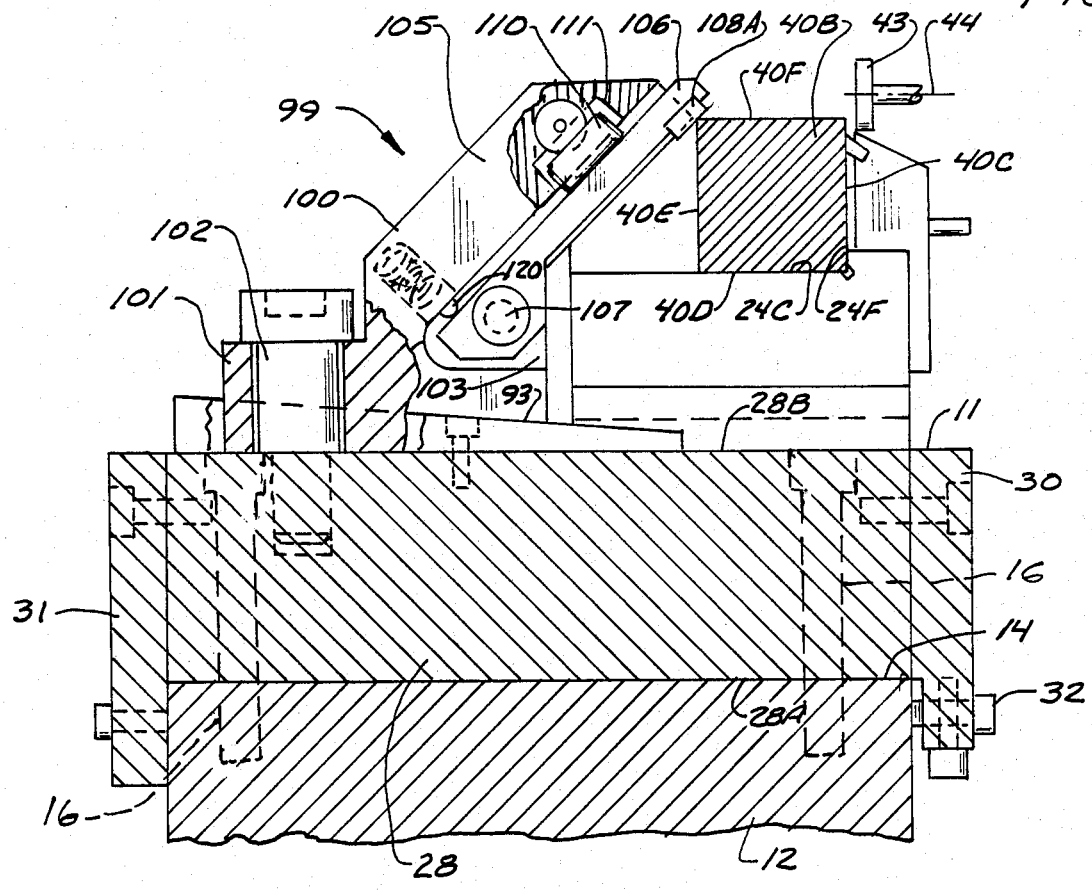
FIG. 3 is a sectional view taken generally along line 3—3 in FIG. 1.

The fixture base 11 is part of a cassette holding fixture 23, and the cassette holding fixture includes the base 11, and tooling cassette support blocks 24 and 25 on opposite ends of the base 11. The support blocks 24 and 25 are fixed onto an upper surface 26 of the fixture base 11, which is a precision ground surface, that is flat and which is held parallel to the upper surface 14 of the adaptive control table. As shown in FIG. 3, the fixture base 11 includes a central rectangular cross-section fixture block 28 that has precisely ground upper and lower surfaces 28A and 28B. Surface 28A rests upon the precise ground surface 14 of the adaptive control table 12, and the cassette holding fixture 23 is clamped in place with screws 16. The plates 30 and 31, which are fixed to the block 28, are used to hold adjusting screws 32. Adjusting screws 32 are threaded through the plates 30 and 31 and bear against the side surface of the adaptive control table portion 12 for adjusting the fixture base 11 in position when the surface 28B is seated to be parallel to the upper surface of the adaptive control table 12.

The cassette support blocks 24 and 25 are thus supported on the upper surface at 28B of the block 28 and as can be seen the blocks 24 and 25 are L-shaped, with lug base portions 24A and 25A, and upright support portions 24B and 25B, respectively (see FIG. 1). The cassette support blocks 24 and 25 are mirror images of each other, and on the upper sides thereof, the support blocks 24 and 25 each have a very precisely ground support surface portion 24C and 25C, respectively, as well as a fastening portion 24D and 25D, respectively (see FIG. 2), in which cap screws are used for holding the cassette support blocks in position.

The support surfaces 24C and 25C are the surfaces on which a part clamping cassette assembly indicated generally at 35 is supported. The support blocks 24 and 25 also have upright locating lugs 24E and 25E, respectively, which in turn have locating shoulder surfaces that are shown at 24F in FIG. 4, and 25F in FIG. 2. The locating shoulder surfaces 24F and 25F are precisely 90° to the surfaces 24C and 25C, and which surfaces 24F and 25F are coplanar with the position of the part clamping reference surface plane indicated at 35A in FIG. 4.

The part clamping cassette assembly 35 includes a cassette body 36, which has a reference bar support surface 37, and a forward surface 38. A tooling reference bar 40 is supported on the surface 37. As shown, the reference bar 40 has end portions 40A and 40B which extend outwardly beyond the lateral sides of the cassette body 36. The positioning of the end portion 40A can perhaps best be seen in FIG. 1, where it is shown extending over the surface 24C on support block 24, and is positioned behind (and against) the shoulder 24B. The bar 40 is broken away at the left-hand end in FIGS. 1 and 2, for clarity, but both ends of the reference bar are supported in the same manner, and end 40B can be seen in FIG. 2 in dotted lines.

The reference bar 40 has four side surfaces, which extend longitudinally of the bar, and which are ground and lapped flat and which are perpendicular to the next adjacent surfaces and parallel to the opposite surface. These surfaces include surfaces 40C, 40D, 40E and 40F. Each of the bar side surfaces can form a reference surface depending on the positioning of the reference bar. As shown in the drawings, the surface 40C abuts against the locating surfaces 24F and 25F of the blocks 24 and 25. Surface 40C forms the reference clamping surface, and the reference tooling surface, as shown. The surface 40D forms a reference bar support surface, and rests on the surfaces 24C and 25C.

It can be seen in FIG. 3, for example, that the corner where the surfaces 24F and 24C meet, is relieved with a recess or relief, and so the bar 40 will be positioned precisely. The surface 40C forming the reference surface is precisely perpendicular to the axis of the machine tool, as shown a grinding wheel 43, that has an axis of rotation 44.

The part clamping cassette assembly is used for clamping piece parts. The cassette body 36 of forward surface 38 is relieved by a relief surface 46, which forms a shoulder surface 45 that is straight, parallel to the surface 37, and thus parallel to the undersurface 40D of the reference bar 40.

Figure 6:
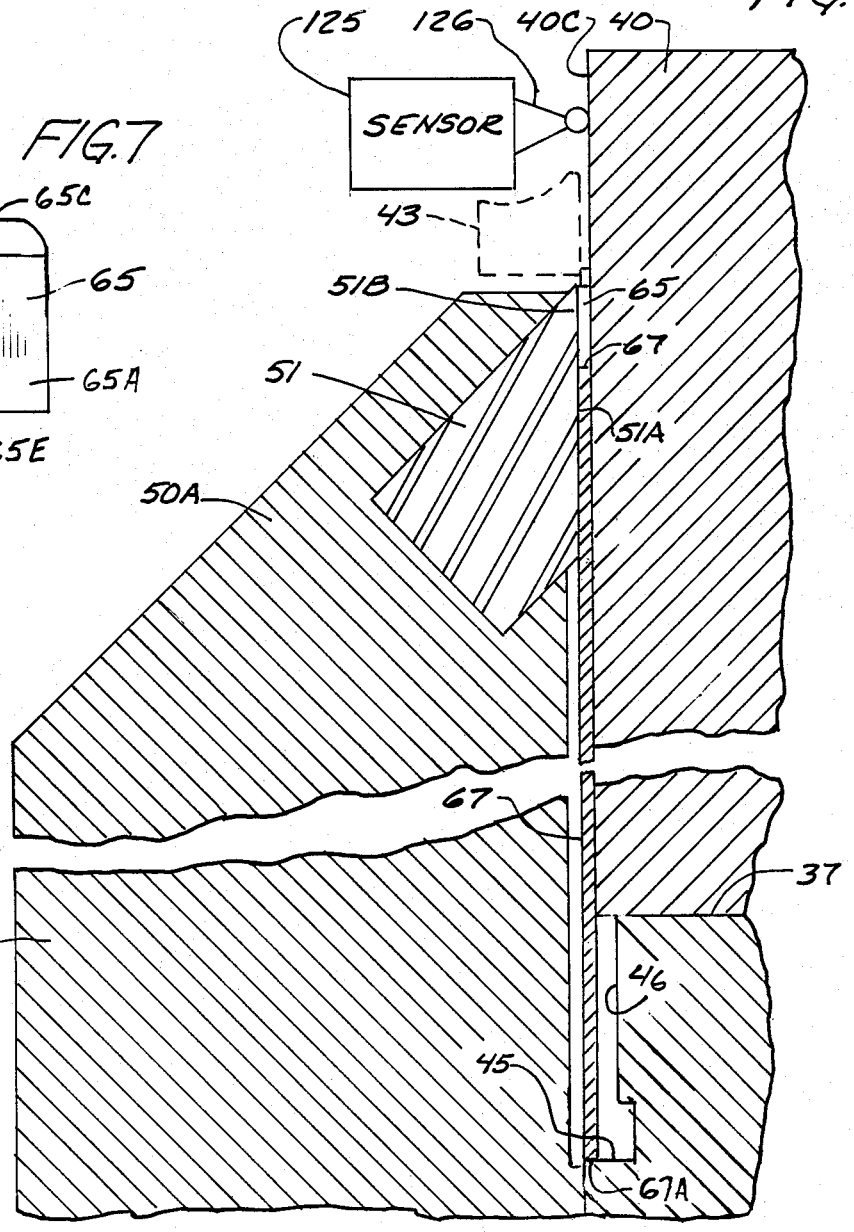
FIG. 6 is a substantially enlarged sectional view showing a typical piece part being clamped against a reference bar and illustrating a support shoulder formed on a cassette body.

A suitable depth of relief of surface 46 is provided, so that there is not any interference between the edge of the shim and the corner of surfaces 45 and 46, as can be seen in FIG. 6. This relief is the cause for part breakage if the parts are supported directly on a shoulder because the parts would not be supported at their recess area. That problem is eliminated with the present invention. Additionally, the part clamping cassette assembly includes a fixed jaw 50, which as perhaps can be seen best in FIG. 4 and also in FIG. 6, has a lower portion that is clamped against surface 38 of the cassette body 36 using suitable cap screws. The fixed jaw 50 extends upwardly beyond the surface 37 to have an active jaw portion 50A that has an elastomeric jaw insert face strip 51 positioned in a suitable recess in the jaw and which faces toward the reference bar 40, and specifically the bar surface 40C. The fixed clamp jaw 50 (in the form shown) is used as a backing against which the piece parts to be ground are clamped, also using the reference surface 40C of the reference bar 40 for a second jaw of the clamping assembly.

The cassette body 36 has a rear column 54 (see FIG. 4) that is formed when the surface 37 is formed. There is a surface 55 that joins the surface 37, and which faces or mates with the surface 40E of the reference bar 40.

Figure 5:
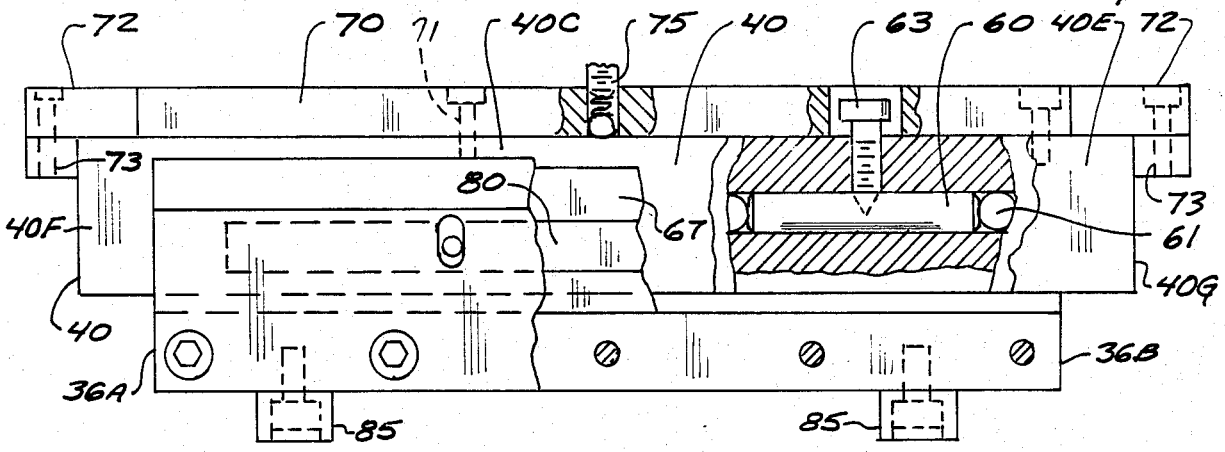
FIG. 5 is a front elevation view of the cassette assembly used with the present invention, with parts in section and parts broken away.

The reference bar is made so that it will slide on the surface 37 for providing the clamping action against jaw 50, and in this form of the invention, the column 54 is provided with a suitable slot or recess 57 that extends longitudinally, and has an axis that is parallel to the surface 37. This recess 57 is large enough to hold three individual rollers 60, one of which is shown in FIG. 5. The rollers 60 are held in place with cross pins 61 that are at each end of the rollers (that may only be two of the rollers 60 if desired). The cross pins are held in suitable bores in the column 54 of the clamping cassette body 36.

The rollers 60 operate to provide a clamping action tending to urge the reference bar 40 toward the fixed jaw 50 through the use of conically ended screws 63 that are threaded into the upper portions of the column 54 of the cassette body 36. When the screws 63 are threaded to move in toward an aligned roller 60, the conical end portion of the screw will urge the roller out against the surface 40E of the reference bar 40 and urge the reference bar toward the fixed jaw 50. There are three of these screws 63 (and three rollers 60) used for adjusting the clamping force of the reference bar 40 to arrive at the desired clamping pressure.

Figure 7:
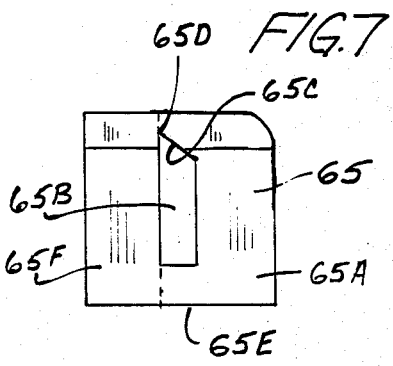
FIG. 7 is a plan view of a typical piece part that is ground utilizing the clamping cassette of the present invention.

In order to prevent excessive loading of the individual piece parts which are shown in FIG. 7 at 65, and also are shown in FIG. 6 in clamped position, the edges of the piece parts 65 are supported on a continuous edge and are fully backed by the reference surface 40C of the reference bar 40. This is accomplished by use of a shim 67 that has precisely ground parallel longitudinal upper and lower edges, and is of substantially the same thickness as the piece parts 65. The shim 67 can be made of a resilient stock, and in the form shown is 0.006 inches thick, which is the typical thickness of the piece part 65. A first edge 67A of the shim is supported on shoulder 45 and the piece parts 65 then are supported on the opposite edge 67B of the shim 67. The rubber clamping insert 51 for the jaw 50 has a clamping surface 51A that rests partially against the surface of the shim 67 and when the reference bar 40 is clamped toward the fixed jaw 50, the reference surface 40C will urge the shim 67 and the piece parts supported thereon toward the surface 51A. The piece parts 65 are held against the surface 51A of the resilient clamping jaw insert near the upper edge or corner portion 51B of the resilient clamping strip 51.

It can be seen that the fixed jaw 50 has a beveled surface at the upper end sufficient to provide clearance for the grinding wheel 43 and sensor 125 which are shown in FIG. 6 as well as in FIG. 3.

As clamping occurs, the piece parts 65 are fully supported along one entire side surface, and the forces from screws 63 and rollers 60 that are acting to move the reference bar 40 toward the fixed jaw 50 can be distributed more evenly because a substantial portion of the surface 51A is aligned with the shim 67, which makes controlling the clamping forces more easily accomplished. Adequate clamping forces of the piece parts 65 are provided, and because the surfaces of the piece parts that rest against the surface 40C, and which are engaged by the surface 51A may not be absolutely smooth or planar, the elastomeric jaw surface will conform to these irregularities and provide good clamping action.

A number of piece parts can be placed into the clamping cassette and supported on the surface 67B of the shim, as shown schematically and typically in FIG. 1, and these then can be lined up along the upper edge 67B of the shim before clamping completely. The clamping action can be provided using the screws 63. The loading of parts can be done with the cassette rotated so surface 40C faces upwardly so the parts can be slid into position easily.

Figure 2:
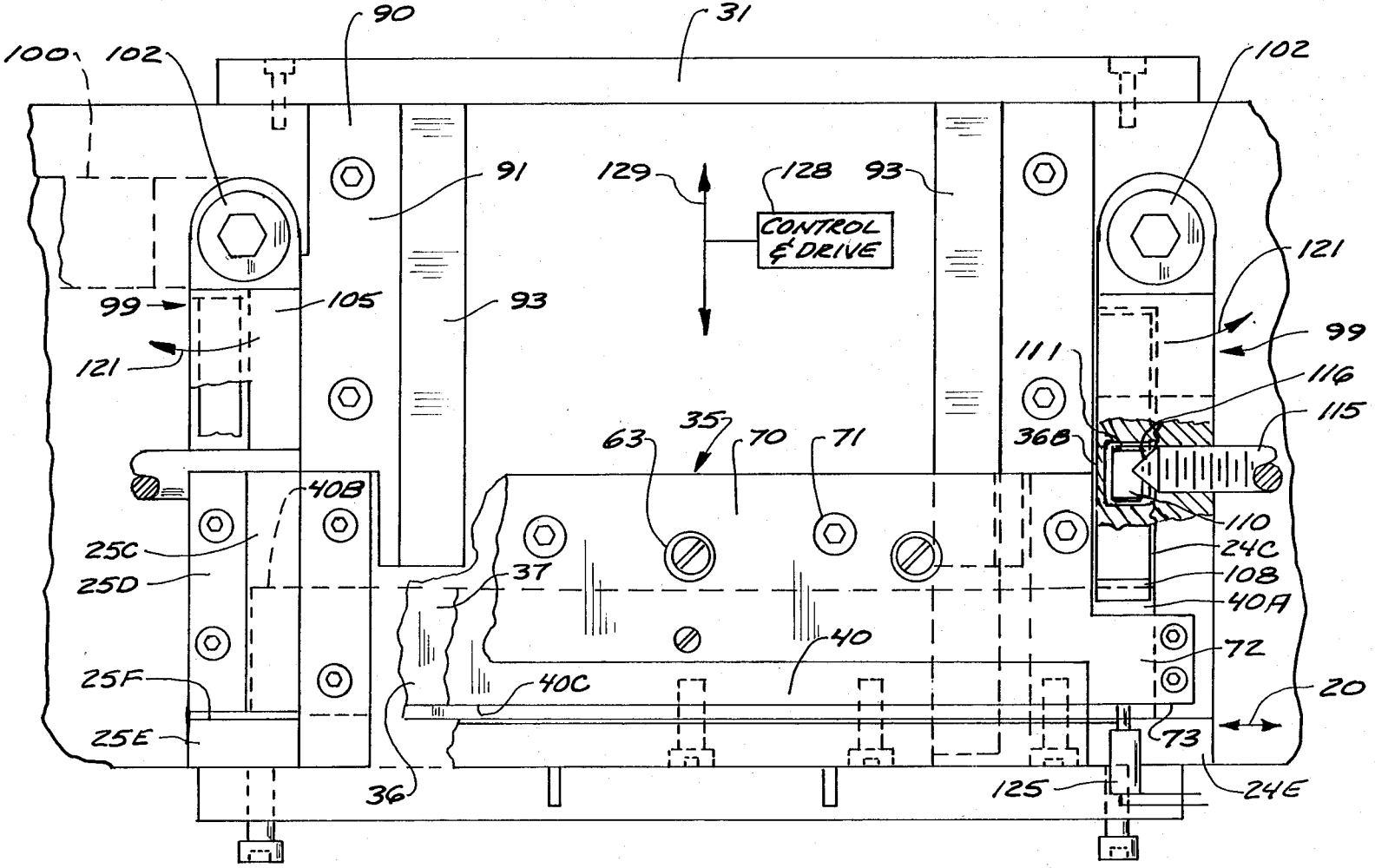
FIG. 2 is a top plan view of the device in FIG. 1, again with parts in section and parts broken away to illustrated detail.

The reference bar 40 is held in position, in a precise location on the cassette body 36 through the use of a top cap plate 70 that is clamped onto the upper surface of the column 54 of the clamping cassette body 36 with suitable cap screws, as shown. Such cap screws are shown at 71 for example. The cap 70 has outwardly extending end wing portions 72 that extend laterally out from the end surfaces 36A and 36B of the cassette body, as can be seen in FIGS. 2 and 5, and these outer end portions 72 are used for connecting stop lugs or positioning lugs 73 on the lower sides thereof for abutting against end surfaces 40G of the reference bar 40. The lugs 73 position the reference bar 40 in the cassette body in proper location, so that there are adequate portions of the surfaces 40C and 40D protruding outwardly from the ends 36A and 36B of the cassette body which are shown in FIG. 5 in particular, so that the cassette body 36 will fit between the support blocks 24 and 25 and the reference bar end portions 40A and 40B will be supported on the surfaces 24C and 25C.

The cap 70 does have a spring plunger 75 that can be threaded down to hold the reference bar 40 in its location before it has been clamped onto the piece parts by operating the rollers 60 through the use of the screws 63.

The shim 67 is clamped only by the resilient jaw surface 51A, because the fixed jaw 50 has a relief to space it from the shim 67 as shown in FIG. 6. In addition, the shim 60 has a control bar 80 fixed thereto. Control bar 80 can be epoxied or connected in place on the outer surface of the shim 67, and suitable control pins 81 protrude from the bar 80 outwardly through provided slots 82 in the fixed jaw 50. The bar 80 fits within a recess 83 in the fixed jaw 50 so that when the clamping force from reference bar 40 is released the pins 80 can be used for lifting the shim 67 upwardly so that the edge 67B will urge the piece parts 65 upwardly by shear forces to release them from the elastomeric jaw member 51. The piece parts can be removed quite easily from the cassette assembly after having been ground.

The bar 80 is of size so that the recess 83 does not restrict movement of the shim 67 with the shim surface 67A against the shoulder 45.

The cassette body 36 also has a pair of rails 85 on the bottom thereof, which are spaced laterally apart as shown in FIG. 1 and also in FIG. 5. These rails 85 have end portions that protrude outwardly beyond the forward surface 38 of the cassette body 36, so that the rails provide a support surface for the lower end of the fixed jaw 50 as shown at 87. The lower surface of the body 36 can be ground very flat, and the rails 85 can be ground flat so that the positioning of the fixed jaw can thus be maintained precisely when it is first clamped into position against the surface 38, by resting the fixed jaw on the surface 87. This is important when the clearances that are provided for the piece parts and for the grinding wheel are very small. Also, the jaw 50 then is held so that it is parallel to the support surface 37 and is not cocked or misaligned when parts are clamped.

Figure 4:
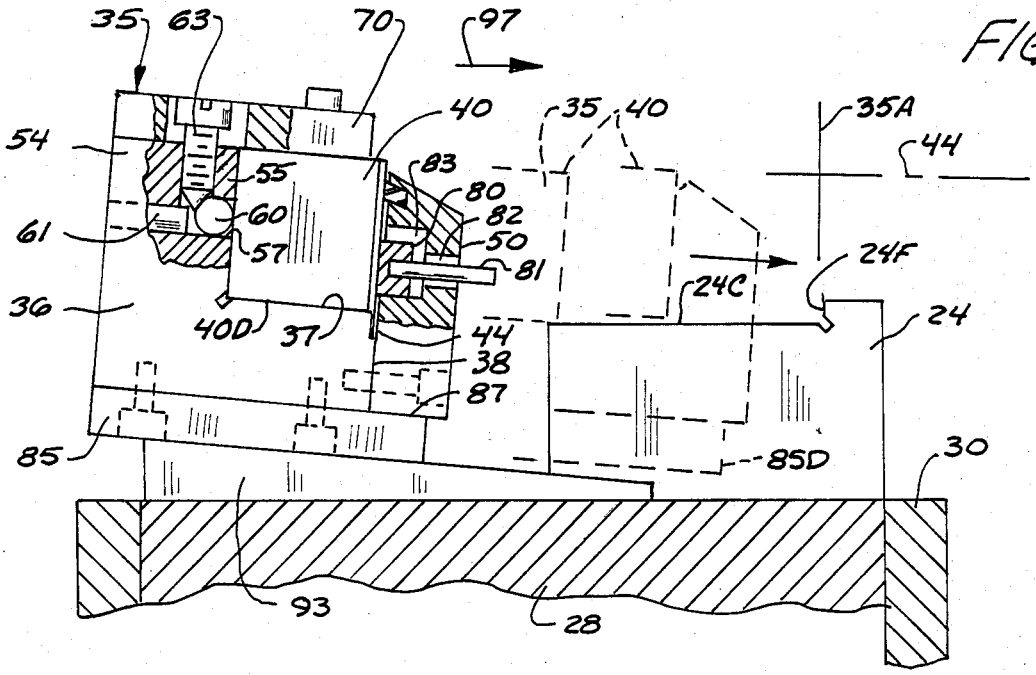
FIG. 4 a part schematic representation taken along a plane corresponding to that of FIG. 3, with a cassette assembly shown in a process of installation, and with parts in section and parts broken away in the cassette assembly to illustrate the construction.

Additionally, the rails 85 serve a function for installation of the cassette assembly 35 onto the cassette support fixture 23. The base body 28 has a pair of slide assemblies 90 mounted thereon. The slide assemblies 90 include a mounting plate portion 91, through which cap screws extend to clamp the slide assemblies into position. The assemblies 90 also include a pair of tapered slides 93,93 which are spaced apart and which have upper surfaces that taper from a greater height adjacent the edge of the block 28 opposite from the support blocks 24 and 25, down to a lower height adjacent the blocks 24 and 25. These tapered slides are shown in FIG. 4. The rails 85 will rest on these upper surfaces of the wedge-shaped slides 93 when the clamping cassette assembly 35 is positioned at the rear part of the block 28. In this position, the cassette then can be moved as shown in FIG. 4 toward the surface 24F, to position shown by dotted lines at 35 and 40, wherein the edge of the reference bar 40 and the end portions 40A and 40B will engage the surfaces 24C and 25C gently. The edge of the reference bar 40 right at the corners of the bar 40 can be chamfered at an angle, so that there is no sharp corner tending to engage and dig into the surfaces 24C and 25C. The reference bar 40 gradually slides onto the surfaces 24C and 25C, and as the part clamping cassette assembly 35 is moved farther in the direction indicated by the arrow 97, it becomes supported on the surface 40D at opposite ends of the reference bar 40, and the rails 85 lift away from the tapered surfaces on the slides 93, as shown in dotted lines at 85D in FIG. 4.

It should be noted that the tapered surfaces of slides 93 extend forwardly between the support blocks 24 and 25, and the portions 91 of the slide assemblies 90 are cut away for clearance around the blocks 24 and 25.

When the reference bar 40 is fully seated against the locating surfaces 24F and 25F, the only support for the entire cassette assembly relative to the cassette holding fixture 23 is at the surfaces 24C and 25C, and the lugs or rails 85 are clear of the upper surface of the block 28.

The part clamping cassette assembly 35 is clamped in the cassette holding fixture 23 using releasable clamping assemblies 99, which clamp only the end portions 40E and 40F of the reference bar 40 onto blocks 24 and 25, to hold the entire cassette assembly in position. The clamping load that is exerted on the piece parts is not altered by clamping the cassette assembly 35 into the cassette holding fixture 23.

The clamping assemblies 99 for reference bar 40 on the cassette holding fixture are made so they engage only one corner of the reference bar 40. clamp assembly 99 can perhaps best be seen in FIG. 3. The clamp assemblies 99 can be swung laterally out of the way, when the part clamping cassette assembly 35 is being put into place, as will be explained. Each of the clamp assemblies 99 includes a clamp body or housing 100 that has a pivot support lug 101 pivotally mounted on a shoulder bolt 102 that is threaded into the block 28 of the cassette holding fixture. It can be seen that the support lug 101 has an upper surface that is relatively low so that the top of the head of the shoulder bolt 102 remains below the surface 24C (and 25C). When the clamp bodies 100 are swung out, the end portions 40A and 40B of the reference bar 40 will pass easily over the heads of the pivot bolts 102.

The clamp bodies 100 have an upwardly inclined backing member 105, which has a recess 103 therein. The recess 103 is shown in FIG. 3, and also can be seen in FIG. 2 on the right-hand side where the body 105 is broken away. A clamp lever 106 is positioned in the recess 103 and is pivotally mounted on a suitable pivot pin 107 to the side portion of the clamp body 105 for pivotal movement about a generally horizontal axis, or in other words about an axis that is parallel to the surfaces 24C and 25C.

Each clamp lever 106 has a hub that is cut away so that it does not interfere with the cassette body 36, and inclines upwardly within the recess 103. Each clamp lever 106 has an outer clamping pad 108 at its upper end which is positioned, when the levers of the clamp bodies are in their solid line position in FIG. 2, to overlie the end portions 40E and 40F of the reference bar 40. End portion 108 of one clamp lever 106 can be seen overlying the portion 40E in FIG. 2.

The recesses 103 each include a pocket respective body 105. Each clamp lever 106 has an actuator roller 110 resting on its upper surface which extends up into portion 111 of the respective recess 103, (see FIG. 3). The actuator roller 110 is made so that a clamping screw 115 on each of the clamp bodies 105 can be threaded so that a conical end portion 116 (see FIG. 2) will engage the cylindrical surface of the roller 110 and will force the associated clamp lever 106, and particularly the outer end 108 thereof, which includes the pad 108A, against the aligned corner of the reference bar 40. The force from the two clamping levers 106 will tend to urge the reference bar 40 against the surfaces 24C and 25C respectively, and also against the locating surfaces 24F and 25F.

Substantial clamping force can be obtained with the manually operable heads 118 on the screws 115. The rubber pads 108A can be glued into position on the end portions 108 of the levers 106.

Each of the levers 106 has a spring-loaded return plunger 120 that bears against an upper surface thereof adjacent the hub through which the pin 107 passes, and the spring is shown in dotted lines and goes into the clamp housing 105. When the screws 115 are released, the clamp levers 106 will then be urged to pivot so that the pads 108A move away from the reference bar 40, and when the bar 40 is released, the clamp assemblies 99 can be moved to a position 90° from the clamping position, or any place in between, by swinging the clamp bodies 100 as shown by the arrows 121 to the dotted line position shown in FIG. 2.

Thus, when the clamping cassette assembly 35 is clamped into position on the cassette holding fixture 23, the part clamping cassette assembly is held precisely with the reference surface 40C in its proper location.

A sensor will run along the surface 40C as previously stated, for providing a position signal for controlling the in and out motion of the tool table. A sensor is shown schematically in 125 in FIG. 2 and also in FIG. 6, and the sensor 125 has a rounded end 126 which slides along surface 40C as the machine tool table is moved in direction parallel to the surface 40C. The sensor 125 controls the in and out control and drive indicated generally at 128 in FIG. 2 for controlling the movement of the machine tool table as indicated by the double arrow 129. As the machine tool table moves as indicated by the double arrow 20 during grinding, (see FIG. 2), the sensor 125 insures that the reference surface 40C is maintained at the proper in and out location, so that the grinding wheel 43 will grind the proper depth shoulder into work pieces 65 that are held clamped in place.

When the reference surface 40C of the reference bar 40 becomes worn by sliding movement of the sensor end 126 along such surface, the reference bar 40 can be released, and rotated 90° about its longitudinal axis so that a new surface such as surface 40D will then become the reference surface, and the surface 40E would become the locating or seating surface resting on the surfaces 24C and 25C.

Additionally, since only one upper edge or corner portion of the reference surface of the reference bar 40 is used for the sensor, as shown, flipping the reference bar end for end will place the opposite edge of the same side surface at the top, as can be seen in FIG. 1, to provide for a new surface for the sensor end 126 to run against.

The parts are so small that only about 0.040 inch of a part is available for clamping. The present invention permits secure holding even with this small area.

In FIGS. 8 through 11, a modified form of the invention is shown, wherein the reference surface means used for the sensor and for clamping the part are parallel, but are oppositely facing. The part being worked on is supported at an angle relative to the axis of the grinding wheel. In this form of the invention, the same cassette body is utilized and will be shown with the same number, but the cassette assembly is different and the clamping arrangement is oriented differently with respect to the grinding wheel. The cassette assembly shown generally at 150 in the second form of the invention includes the cassette body 36, which is formed in the same manner as the body before, and includes a reference support surface 37 formed on the body parallel to the axis of the grinding wheel. The body has the upright column 54 formed therein. The rails or guides 85 are provided on the bottom surface, and the entire cassette assembly 150 can be held in the cassette holding fixture that was previously shown, for positioning adjacent to a grinding wheel that is illustrated at 152, and which has an axis 153 shown in FIG. 9 in particular.

The individual parts illustrated in FIG. 7 and indicated at 65 are made up into two pieces. A first piece shown at 65A is formed to have the opening therein, and is made initially so that this opening indicated at 65B has an open side face, and a surface 65C has to be ground in with very precise tolerances so that the corner indicated at 65D is at a precise location with respect to the reference edge indicated at 65E. Each piece 65A is then cemented or glued onto the closing portion 65F, and the point 65D is precisely located when this is done. The tolerances involved are in the range of 50 millionths of an inch, which is difficult to hold with conventional equipment, but the use of the clamping arrangement disclosed herein permits much closer tolerances to be held because of the precisely located reference surfaces.

Figure 8:
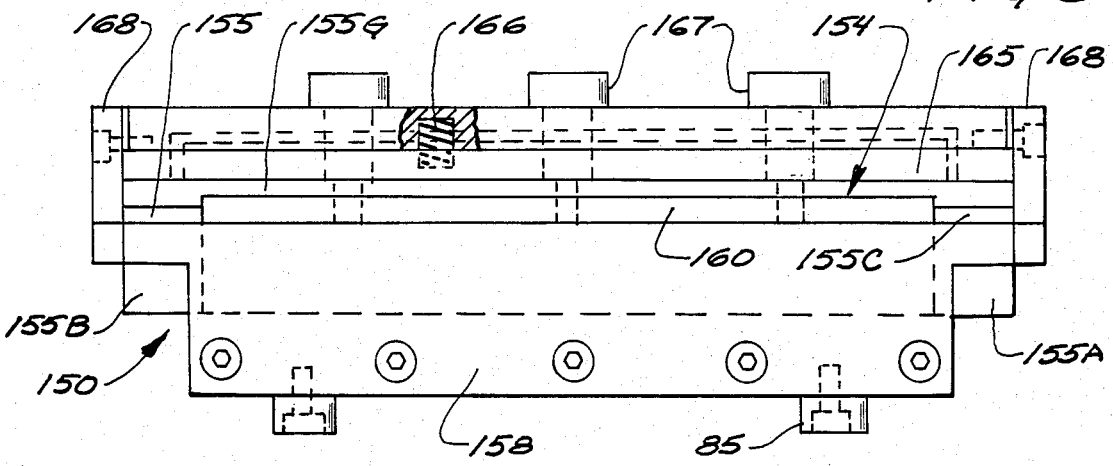
FIG. 8 is a front elevational view of a cassette assembly means according to a modified form of the present invention.
Figure 9:
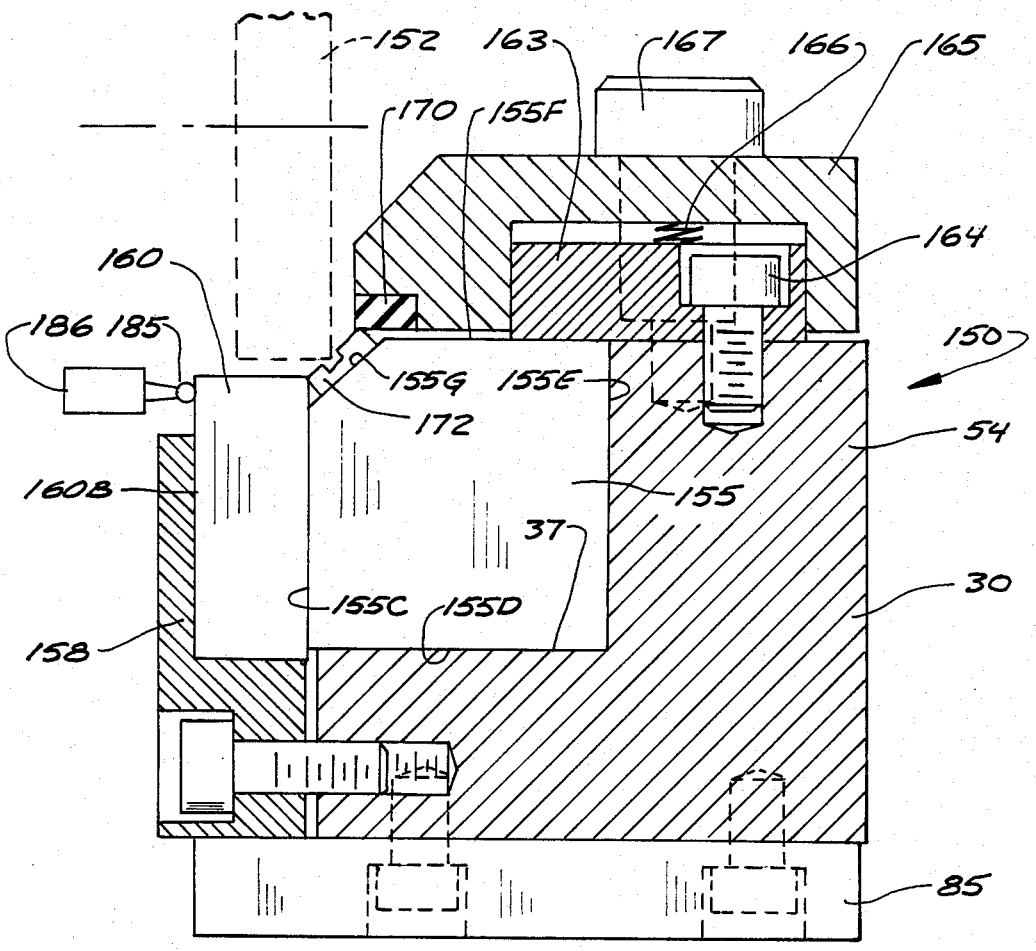
FIG. 9 is a sectional view taken on line 9—9 in FIG. 8.
Figure 10:
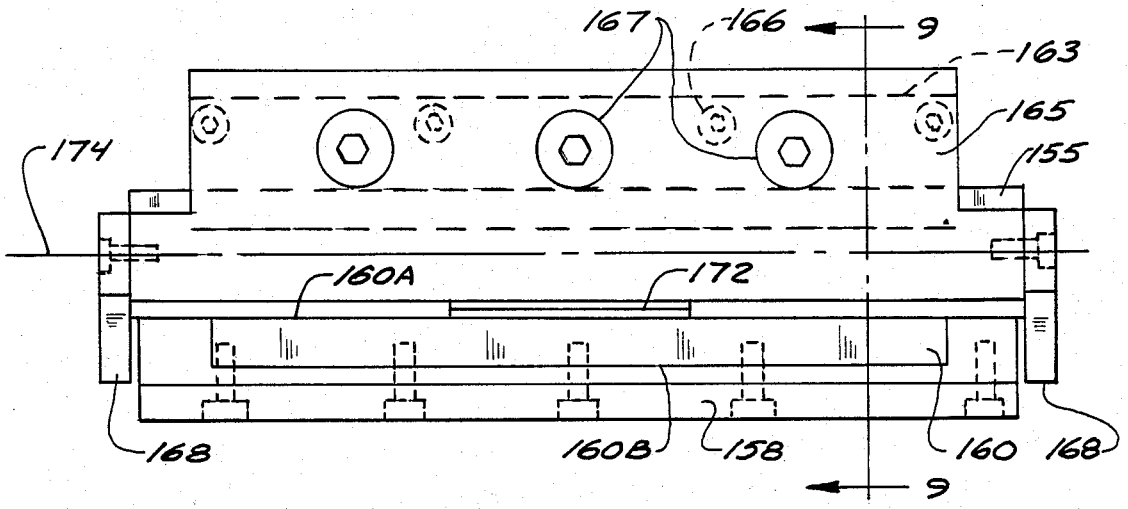
FIG. 10 is a top plan view of the device of FIG. 8.

In this form of the invention, a reference bar means is shown at 154 and includes a main reference bar 155 made as before, and as can be seen in FIG. 8, for example, it has end portions 155A and 155B that are supported on the reference surface of the cassette holding fixture, as before, and which protrude outwardly beyond the side edges of the cassette body 36. The reference bar 155 has straight, precisely located surfaces 155C, 155D, 155E, and 155F, respectively, with the surface 155D supported on the surface 37 of the cassette body 36. At least one corner of the reference bar 155 is machined (ground straight and flat at a precise angle) to provide a chamfered support reference surface 155G. The bar 155 is held in place in the receptacle formed in the body 36 with a forward clamp member 158 that holds a precisely ground supplemental reference bar 160, which forms a part of the reference bar means 154. This supplemental reference bar 160 has a pair of parallel surfaces 160A and 160B, that are precisely located, and which are ground flat, and the surface 160A is clamped with the clamp member 158 against the surface 155C so that these surfaces are coplanar, and the surface 160A essentially forms an extension of the surface 155C but faces in an opposite direction. The surface 160B is parallel to the surface 155C and also forms a reference surface means of the reference bar means used with this form of the invention, which includes main reference bar 155 and supplemental reference bar 160.

A top clamp bar 163 is mounted on the top of the pedestal 54 of body 36 in this form of the invention with suitable cap screws 164, and provides a guide for holding the clamp jaw 165 adjacent to part clamping reference surface means 155G and 160A of the reference bar means 154. The clamp jaw 165 is spring loaded with suitable springs indicated at 166 away from the reference bar 155, and is capable of being held in place and clamped in direction toward the reference bar means through the use of a plurality of cap screws 167 that thread into the column 54 of the body 36, and which are shouldered so that they can only be threaded inward a limited amount. The clamp jaw 165 has end plates 168 on opposite ends which position and guide the reference bar 155.

By loosening the bolts or cap screws 167, the jaw 165 will move away from the reference bar 155. The jaw 165 has an elastomeric or rubber face rib 170 adjacent its clamping end, which is used for engaging a piece part to be ground indicated generally at 172, which comprises a bar that has a length of one to two inches or more in direction along the longitudinal axis of the reference bar 155 which is indicated at 174 in FIG. 10. Individual pieces 65A for the part 65 of FIG. 7 will be sliced from part 172. In other words, the parts 65A are only 0.060 inch thick, and the premanufacturing steps for grinding the surface 65C and the precisely located corner 65D is done prior to the time that the individual piece parts 65A are separated out into the 0.060 inch thick pieces.

Figure 11:
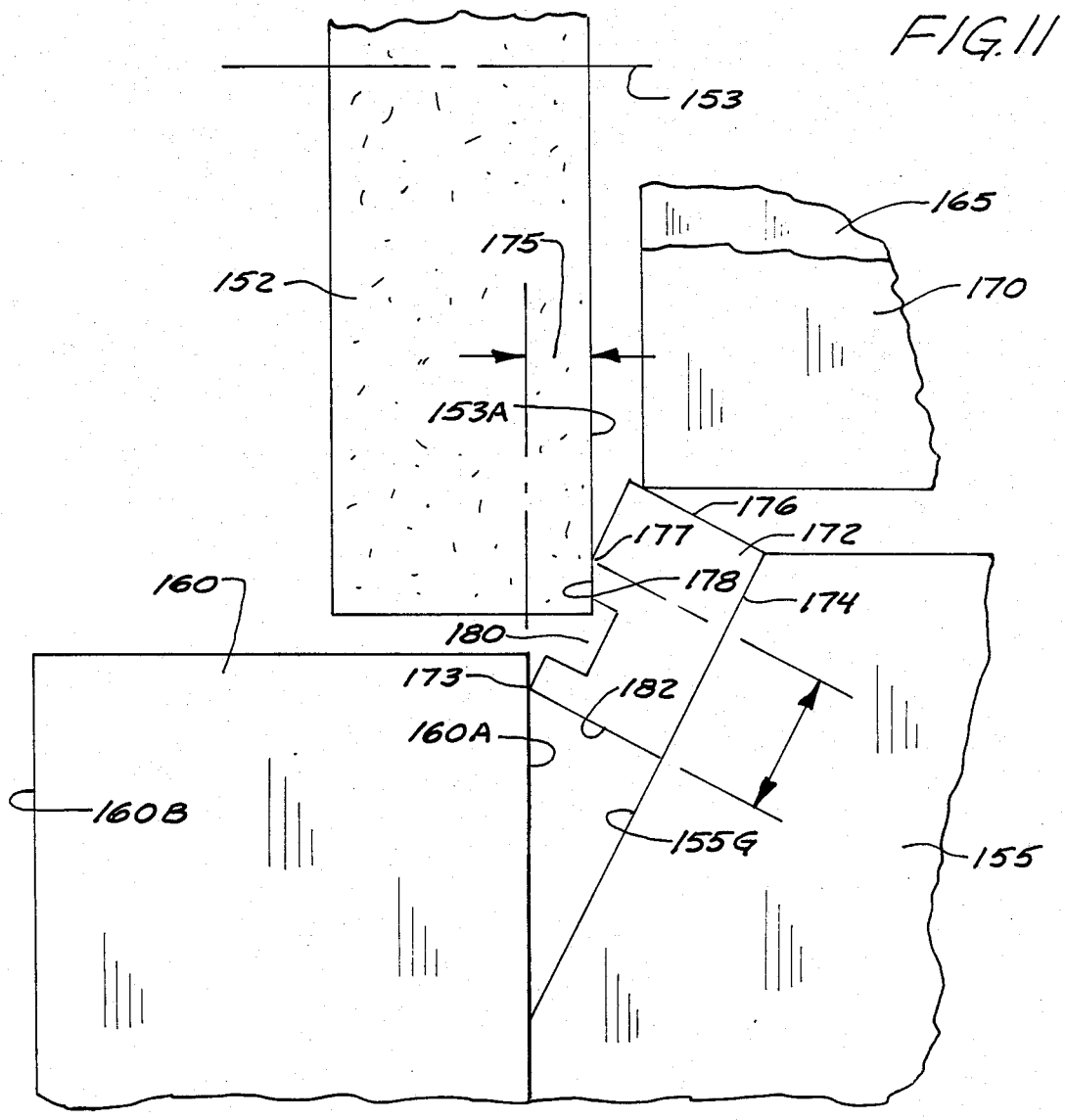
FIG. 11 is a substantially enlarged sectional view showing a piece part being worked on clamped in position in the cassette assembly of FIG. 8.

Referring to FIG. 11, the supplemental reference bar 160 is shown in position, and the main reference bar 155 is shown from an end view, and the surface 155G as shown is inclined or chamfered very precisely at a set angle with respect to the surface 160A. As shown, it is at an angle of 27°. The piece part 172 which comprises an elongated bar that will be sliced into individual parts 65A, also is shown resting against the surface 155G and has a reference corner 173 engaging the surface 160A. Corner 173 is at the surface 182 of the part 172, which will become the reference support edge of piece part 65.

When the back surface 174 of the piece part 172 is resting on the surface 155G, and the corner 173 is engaged with the surface 160A, the dimension that is indicated at 175 is very precisely set, and thus when the clamp jaw 165 is clamped with screws 167 against the surface 176 of the piece part 172, the corner 173 is held tightly and securely against the surface 160A. Surface 160A forms the reference surface means on the reference bar means 154 to precisely hold the dimension 175, so that the grinding wheel side edge indicated at 153A will engage the piece part 172 to precisely form the corner edge or line 177 as it grinds the surface 178. When the individual parts are sliced off the surface 178, forms the surface 65C of the piece 65A, and the corner or line 177 forms the corner 65D of the individual piece 65A.

The bar or piece part 172 is formed with a longitudinally extending recess 180 into which the edge of the grinding wheel 153 will extend, to permit it to grind off the surface 178 very precisely to precisely locate the corner 177, which is the critical corner for manufacturing, with respect to the reference surface 182 on the bottom of the part 172 which becomes the surface 165E of the individual pieces 65A.

Reference surface 160B on supplemental reference bar 160, which is parallel to the surface locating the reference corner 173 provides for a location for running of finger 185 a sensor 186 (FIG. 9) for controlling the position of the tool table in direction of the axis 153 as described in relation to the use of the sensor 125 in the first form of the invention.

The advantages of having a clamping cassette are thus achieved for differently shaped parts.

Again, the cassette assembly 150 can clamp the parts into position, utilizing reference bar means, which is assembled and has a plurality of surfaces that form reference surface means for clamping a part precisely with respect to a jaw (in this form the jaw is movable). The reference surface means is precisely located both for running a sensor for controlling the tool table as the table moves parallel to the reference surface as well as for locating the critical edges or portions of the part. In both forms of the invention, the reference bar means provides a reference surface for permitting the sensor to slide along the bar. The reference bar 160 has more than one surface that can be precisely formed, and which can be removed from the cassette easily for repositioning a second surface, or for replacement or regrinding. Also, flipping bar 160 end for end permits a second edge of each surface 160B or 160A to be used for the sensor guide surface.

Although the present invention has been described with reference to preferred embodiments, workers skilled in the art will recognize that changes may be made in form and detail without departing from the spirit and scope of the invention.

What is claimed is:

1. A tooling fixture comprising a body;

means for mounting said body on a machine tool having a tool element that rotates about a tool axis for performing work on a work piece;

reference bar means removably mounted on said body and comprising reference surface means against which work pieces to be worked on are clamped, the reference surface means being mounted at a known position relative to the tool axis, said reference bar means having a mounting surface formed at a known angular position to at least a portion of the reference surface means with both the reference surface means and the mounting surface being parallel to a longitudinal axis of the reference bar means;

a clamping jaw mounted on said body adjacent to said reference bar means; and means for supporting a work piece engaged with the reference surface means to be clamped between said clamping jaw and said reference bar means as said reference bar means and said jaw are urged together, at least one of the reference surface means and said mounting surface having portions for precisely locating the reference bar means on a separate support.

2. The apparatus as specified in claim 1 wherein said body has a support surface that is ground to be parallel to the axis of rotation of a machine tool element used with the tooling fixture, said surface on said body being adapted to support the mounting surface of said reference bar means.

3. The apparatus as specified in claim 2 wherein said reference surface means has a longitudinal axis and the reference surface means is formed on a rectilinear cross section reference bar means which is removably mounted on the body, and which bar means has a surface portion parallel to the reference surface means fixed relative to the reference surface means, an exposed portion of said surface portion being positioned adjacent one edge of the bar means for engagement by a sensor means for controlling position of the tooling fixture in direction along the axis of rotation of the tool element, and wherein when a tool table is moved in the direction of the longitudinal axis of the reference surface means the sensor means slides along said exposed surface portion.

4. A tooling fixture comprising a body;

means for mounting said body on a movable table of a machine tool having a tool element that rotates about a tool axis for performing work on a work piece;

means on the body forming a reference surface against which work pieces to be worked on are positioned, said means forming a reference surface comprising a reference bar having at least first and second straight surfaces that are substantially straight and flat and at known geometrical relationship to each other so the position of each of the first and second surfaces is at a known reference location;

a clamping jaw mounted on said body adjacent said reference bar;

means for supporting work pieces between said clamping jaw and said reference bar, said reference bar and said clamping jaw being movable together to clamp work pieces therebetween;

said body having a support surface that is at a known geometrical relationship to the axis of rotation of the machine tool element, said support surface on said body being adapted to support the first surface of said relationship bar, the second surface of the reference bar comprising the reference surface; and said jaw and reference surface having longitudinal axes which are parallel, the reference surface extending outwardly in direction perpendicular to the longitudinal axis of the jaw at a location to clear an outer longitudinal edge of said jaw and for an exposed surface portion; and sensor means associated with a machine tool table to engage the exposed surface portion of said reference surface, wherein said table is moved in the direction of the longitudinal axis of the reference surface, the sensor means slides along said exposed surface portion of said reference surface.

5. The apparatus of claim 4 wherein said exposed surface portion is coplanar with the reference surface the reference bar and the workpieces are clamped with the clamping jaw against the reference surface.

6. A cassette for holding a plurality of flat parts against a reference surface on one surface of each part, and against an edge surface in a straight line, which edge surface is perpendicular to the reference surface comprising:

a cassette body having a first support surface that is formed to be substantially flat and straight, and a second edge surface parallel to the first support surface and open to a side of said cassette body, said second edge surface being at a level different from the first support surface, said first and second surfaces being joined by a junction surface that is perpendicular to both of said first and second surfaces;

a jaw member mounted on said body and having a clamping jaw face positioned perpendicular to the said first and second surfaces and spaced therefrom in a direction perpendicular to the first and second surfaces, said jaw face being substantially in alignment with the side of the cassette body on which the second edge surface is formed;

a reference bar having at least two perpendicular surfaces that join along an edge thereof, a first of said perpendicular surfaces on said bar being positioned on said first support surface, and a second of said perpendicular surfaces facing said jaw member and being spaced to be substantially aligned with an edge of said first support surface, where it joins the junction surface of the cassette body;

shim means having substantially straight and parallel edges, one of said parallel edges being mounted on said second edge surface of said body, and a second of said shim edges being supported substantially in alignment with a portion of the jaw face, a side surface of said shim means being positioned closely adjacent said second perpendicular surface of said reference bar; and means for moving said reference bar and said jaw face together to tend to clamp work pieces supported on the second edge of said shim means in a position precisely located with respect to the first and second surfaces of said body.

7. The apparatus as specified in claim 6 wherein said cassette body has a longitudinal length extending in direction along said first and second surfaces, and has first and second ends at opposite ends of its longitudinal length, said reference bar having a length that is greater than the longitudinal length of said cassette body and extending outwardly beyond the opposite ends of said cassette body, said first mentioned perpendicular surface on said reference bar thereby forming a support surface for an assembly comprising the reference bar, the cassetted body, the jaw member and the means for moving the jaw member and reference bar together.

8. The apparatus as specified in claim 7 and a fixture for supporting said assembly, said fixture having means forming spaced lateral first positioning surfaces that are substantially aligned with the outwardly extending portions of said reference bar, and said fixture having a space formed for permitting the assembly to be supported only on the surface of the outwardly extending portions of the reference bar with respect to said fixture.

9. The apparatus as specified in claim 8 wherein said fixture has a second set of positioning surfaces perpendicular to the first positioning surfaces thereon for engaging the second perpendicular surface of said reference bar to precisely locate the second perpendicular surface at a known location on said fixture.

10. The apparatus as specified in claim 9 wherein said second edge surface of said cassette body is formed by making the junction surface relined inwardly from the plane of the second surface of the reference bar so said shim is spaced from the junction surface when the jaw and second surface of the reference bar are clamped together, the second perpendicular surface of said reference bar being substantially aligned with the junction surface when the reference bar is positioned on said cassette body.

11. A tooling fixture comprising a body;

means for mounting said body on a machine tool having a tool element that rotates about a tool axis for performing work on a work piece;

reference bar means removably mounted on said body and comprising reference surface means against which work pieces to be worked on are clamped, the reference surface means being mounted at a known position relative to the tool axis, said reference bar means having a mounting surface at a known orientation to the reference surface means;

a clamping jaw mounted on said body adjacent to said reference bar means, the reference bar means, body and clamping jaw forming a cassette assembly;

means for supporting a work piece engaged with the reference surface means to be clamped between said clamping jaw and said reference bar means as said reference bar means and said jaw are urged together; and said reference bar means having a longitudinal length and having first and second opposite ends of its longitudinal length, said body having a length that is less than the longitudinal length of said reference bar means so that said reference bar means has end portions which extend outwardly beyond opposite ends of said body, the mounting surface on said reference bar means having surface end portions also extending beyond the opposite ends of the body and thereby forming accessible support surface for engagement with an external member for supporting an assembly comprising the reference bar means, the body, and the clamping jaw.

12. The apparatus as specified in claim 11 and a fixture for supporting said reference bar means, said body, and said clamping jaw cassette assembly, said fixture having means forming spaced lateral first positioning surfaces that are substantially aligned with the outwardly extending portions of said mounting surface of the reference bar means, and said fixture having a space formed for permitting the body to be supported only on the mounting surface portions of the outwardly extending portions of the reference bar means with respect to said fixture.

13. The apparatus as specified in claim 12 wherein said fixture has a second set of positioning surfaces perpendicular to the first positioning surfaces thereon for engaging a second surface of said reference bar means to precisely locate the second surface at a known location on said fixture.

14. The apparatus of claim 2 wherein said fixture has at least a pair of spaced tapered slides thereon positioned between the first positioning surfaces, rail means on the body for engaging the tapered slides, the tapered slides having a height such that the mounting surface portions on the outwardly extending portions of the reference bar means is spaced from the first positioning surface when the reference bar means, body and clamping jaw cassette assembly is in a first position on the fixture, and the tapered slides tapering so that as the cassette assembly is moved to a reference position with the rails sliding along the tapered slides, the mounting surface portions of the outwardly extending portions of the reference bar means gradually moves to engage the first positioning surface.

* * * * *

UNITED STATES PATENT AND TRADEMARK OFFICE

CERTIFICATE OF CORRECTION

PATENT NO. : 4,845,899

DATED : July 11, 1989

INVENTOR(S) : Leon G. Dashevsky

It is certified that error appears in the above-identified patent and that said Letters Patent is hereby corrected as shown below:

Column 14, line 64, after "surface" (second occurrence), insert --on--.

Column 15, line 65, delete "relined", insert --relieved--.

Signed and Sealed this

Seventeenth Day of April, 1990

*Attest:*

HARRY F. MANBECK, JR.

*Attesting Officer*

*Commissioner of Patents and Trademarks*